US009995551B2

(12) United States Patent
Whitfield, Jr.

(10) Patent No.: US 9,995,551 B2
(45) Date of Patent: Jun. 12, 2018

(54) UNIVERSAL CUSTOM RECOIL SOLUTION SYSTEM

(71) Applicant: Newell Keith Whitfield, Jr., San Diego, CA (US)

(72) Inventor: Newell Keith Whitfield, Jr., San Diego, CA (US)

( * ) Notice: Subject to any disclaimer, the term of this patent is extended or adjusted under 35 U.S.C. 154(b) by 0 days. days.

(21) Appl. No.: 15/447,142

(22) Filed: Mar. 2, 2017

(65) Prior Publication Data

US 2017/0314883 A1 Nov. 2, 2017

Related U.S. Application Data

(60) Provisional application No. 62/302,186, filed on Mar. 2, 2016.

(51) Int. Cl.
*F41A 21/36* (2006.01)
*F41A 21/38* (2006.01)

(52) U.S. Cl.
CPC ..... *F41A 21/36* (2013.01); *F41A 21/38* (2013.01)

(58) Field of Classification Search
CPC ..... F41A 21/32; F41A 21/325; F41A 21/34; F41A 21/36; F41A 21/38
USPC ..... 42/1.06; 89/14.3, 14.4
See application file for complete search history.

(56) References Cited

U.S. PATENT DOCUMENTS 1,059,093 A * 4/1913 Voeller ..... F41A 25/02 89/37.07
3,491,650 A * 1/1970 Rohr ..... F41A 3/78 42/7
4,524,671 A * 6/1985 Bender ..... F16C 29/04 384/51
5,044,351 A * 9/1991 Pfeifer ..... F41B 85/1426 124/89
5,585,590 A * 12/1996 Ducolon ..... F41A 25/00 42/1.06
7,493,845 B2 * 2/2009 Mantas ..... F41A 3/86 42/1.06
7,854,221 B1 * 12/2010 Gore ..... F41C 27/22 124/63
8,910,558 B2 12/2014 Kent
2003/0200692 A1 * 10/2003 Lakatos ..... F41A 21/36 42/1.06
2010/0031812 A1 * 2/2010 Kerbrat ..... F41A 3/38 89/190

(Continued)

FOREIGN PATENT DOCUMENTS

DE 195 24 418 A1 * 9/1997 ..... F41A 3/78

*Primary Examiner* — Bret Hayes
(74) *Attorney, Agent, or Firm* — Reem Allos

(57) ABSTRACT

A universal custom recoil solution will comprise of, a provided firearm or barrel, prismatic shaped shell housing mounted or connected to the gas block, a gas block with pathways to direct firearms gas pressure from firing bullet into device interior pushing a counter weight, and spring to counter act the firearms recoil when fired. This device is fitted to or around a provided barrel where the counter weight and spring are mounted on and reciprocate from front to back of the systems interior volume. The systems main function is to create a counter balance to the firearms kinetic energy by providing a moving mass, to counter the recoil from the firearms action movement when firing. The gas pressure is also expelled and redirected allowing the device to cycle synergistically with the firearm actions.

20 Claims, 2 Drawing Sheets

(56) References Cited

U.S. PATENT DOCUMENTS

| | | | | |
|---|---|---|---|---|
| 2014/0075799 | A1* | 3/2014 | Hangen | F41A 3/86<br>42/1.06 |
| 2014/0215876 | A1* | 8/2014 | Popa-Simil | F41C 27/22<br>42/1.06 |
| 2015/0308777 | A1* | 10/2015 | Panak | F41A 21/36<br>89/14.3 |

* cited by examiner

UNIVERSAL CUSTOM RECOIL SOLUTION SYSTEM

CROSS REFERENCE TO RELATED APPLICATIONS

This application claims the benefit of U.S. Provisional Application No. 62/302,186 filed on Mar. 2, 2016, which is incorporated by references in its entirety.

FIELD OF INVENTION

The present invention relates to firearm accessories that integrate weighted and spring based recoil systems utilizing gas block and barrel extension to improve accuracy of shooting a firearm.

BACKGROUND OF THE INVENTION

Recoil can affect accuracy from repetitive back to back shots due to factors including but not limited to kinetic energy from action of firearm, barrel rise, muzzle flash, or even the noise created by the firearm. These factors can increase time to make an accurate follow up shot. There are many other devices that can solve one of these factors at a time such as muzzle brakes, flash riders, or even a suppressor but very rarely do these devices cross over into each other's area of the effectiveness for reducing a negatively perceived recoil affect.

SUMMARY

This apparatus is a universal custom recoil solution that covers a holistic spectrum of problems that may be associated with perceived recoil. Due to different calibers and types of firearm actions that exist, this device will be encompassed as a system that can be integrated or built into a firearm, to be custom tuned or calibrated to adjust different aspects of that firearms recoil. This system can come in multiple embodiments due to factors included but not limited to; types of firearm platforms, caliber psi, hand loaded ammunition psi, noise level, barrel rise or any other aspect of perceived recoil. This apparatus can be encompassed in multiple different embodiments using alternative variation in parts, and in multiple combinations but will surround the core design principle and be utilized as a universal custom recoil solution system made for any desired effect on recoil.

When the firearm is fired, the bullet will be propelled by the gases that will be utilized to cycle the firearms action through its gas block or gas system that is typically what also causes recoil. This device is intended to provide a counter balance to the kinetic kick shooters experience from recoil to increase accuracy from consecutively fired shots, by utilizing the same gas pressure that is creating the recoil to negate itself. The material chosen for this system can be metal that should be able to with stand heat and corrosion for most if not all parts if chosen to be made for traditional firearms. For example, included but not limited to (stainless steel, aluminum, or titanium) If chosen to be made for alternative less powerful firearms replicas found in airsoft, paintball, or high-pressure air or water powered types weapons, material choice could possibly be made of polymer material. The preferred type of manufacturing will be machining and welding utilizing CNC machines or manual techniques. If made of polymer for less powerful applications, then 3D printing would be a good alternative mode of manufacturing.

The universal custom recoil solution system is encapsulated around either a provided firearm barrel that would also provide a gas port hole for a gas block to be mounted to and replace the original gas block from the firearms original configuration, or the system can be embodied to have an independent secondary gas block with a barrel extension to be mounted on the muzzle of the firearms barrel, for the purpose of the barrel or barrel extension being utilized to act as a guide rod along the longitudinal axis within the major interior volume of the shell housing for the counter weight and spring to operate and function as a counter balance to the firearms action when firing the firearm; The gas exhaust ports located on the prismatic shell housing; that would otherwise be blocked off by the counter weight in its original or starting position. When the firearm is fired, the gas would travel through the gas block pathways into the shell housing major interior volume, onto the face of the counter weight to push the counter weight against the spring and end wall the gas exhaust ports on the prismatic shell housing can be potentially utilized as thrusters to counter act barrel rise from consecutive shots if those ports where located towards the top end of the device. Once the gas is released from within the system in any direction necessary to counter recoil it would allow the spring to reset the counter weight back to its original starting position after the gas pressure is released, mimicking and working synergistically with the firearm actions movement. If one where to engage in long range shooting with multiple targets, one could use this device to maintain sight picture and stay in control of where the next shot would be placed.

DETAILED DESCRIPTION

Figure 1:
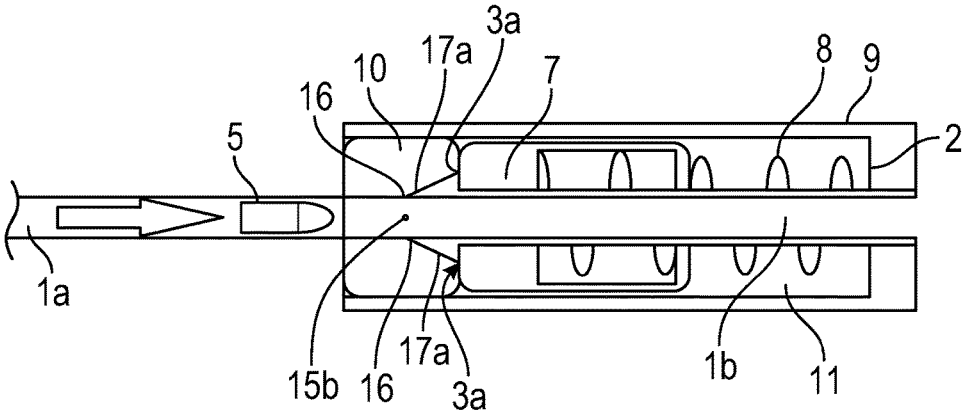
FIG. 1 is a sectional view showing the internals of the firearm accessory apparatus comprising a gas block and barrel extension before a bullet reaches the gas block.

In order to explain the invention more fully, the following table of referred to elements having numeric identifiers is provided for ease of understanding:

1*a*: existing firearm barrel
1*b*: barrel extension
2: end wall
3*a*: forward gas ports
3*b*: rearward gas pots
4: gasses
5: bullet
6: gas exhaust ports
7: counter weight
8: spring
9: shell
10: gas block
11: major interior volume
12: barrel extension endpoint

13: base assembly
14: gas tube
15*a*: barrel gas port
15*b*: barrel extension gas port
16: gas block receiver opening
17*a*: forward pathway
17*b*: rearward pathway
18: muzzle
19: weight stopper When the firearm (not shown) is fired the bullet 5 travels through the firearms barrel 1*a*, in this basic embodiment FIG. 1. the gas block 10 of the device is mounted to the provided firearm (barrel muzzle threads this embodiment of the universal custom recoil system will feature a gas block 10 with a matching thread pitch on the interior front end of the apparatus, to screw onto provided firearm barrel 1*a* for a secure connection to firearm barrel 1*a*. In alternative embodiment, the gas block 10 may feature different types of connections for examples listed but not limited to sight post hook, barrel clamp, pins, weld or an embodiment where the gas block 10 is without a barrel extension 1*b* (FIG. 3. And FIG. 4) to replace the firearms original gas block or it can be modified from the original gas block to accommodate a universal custom recoil solution.

Figure 2:
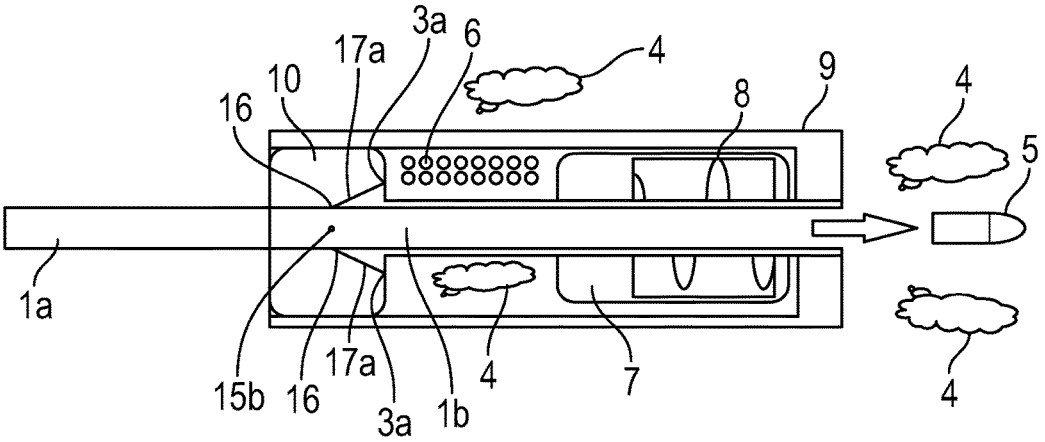
FIG. 2 is a sectional view showing the internals of the firearm accessory apparatus comprising a gas block and barrel extension after a bullet reaches the gas block.

Referring to FIG. 1 and FIG. 2 The gas block 10 will include gas ports 3*a* or forward pathways 17*a* where gasses 4 that travel behind the bullet 5 will expand into and go through to the devices shell housing interior volume 11, where it would push a counter weight 7 that use the barrel extension 1*b* as a guide rod, in a direction opposite of firearms action movement to create a counter balance to the Kinect energy from perceived recoil kick. When the counter weight 7 is pushed to the rearward position of device, a spring 8 between the counter weight 7 and shell housing's 9 end wall 2, will be compressed as well. While both spring 8 and weight 7 are in a rearward position, as shown in FIG. 2, from being compressed by gas pressures 4 from the fired bullet 5, The counter weight 7 will expose the gas exhaust ports 6 on housing shell 9 where in this basic embodiment shown are straight through holes and they are located towards the upper right and upper left, in order to direct the gasses upward in efforts to utilize the gas pressure go create a downward thrust and to push the barrel 1*a* in a downward motion to counter barrel rise, and also exhaust the gases 4 away from the firearms upper center line or line of sight, to avoid heat mirage from blurring the sight for the firearms operator. Exhaust ports 6 can be located on the prismatic shell housing 9 and are featured to direct gas pressure 4 in any direction desired to negate any undesired effects of the firearms recoil.

As shown in FIG. 2, the exhaust ports may be straight through fixed holes, in alternate embodiments they can be threaded holes, slotted shaped holes, or provide an opening in any shape or size, for purpose of being a universal custom solution and potentially have the ability to be used and reconfigured for different firearms. If embodiment is utilized with its threaded port holes, then the firearm operator can adjust and tune the pressure and chosen direction of escaping gas by opening or closing each port using a threaded screw to plug the exhaust ports 6, to achieve optimum performance from system. If the system is not using a counter weight 7 and spring 8 within its major interior volume 11, then the apparatus can be used as a muzzle brake type device to redirect gas pressure 4 for less recoil and increased accuracy from consecutive shots. The exhaust ports 6 are features included to let the gas escape, unlike a suppressor that is intended to trap gasses altogether. If firearm user is permitted by law and has required forms from ATF then the user can utilize an embodiment where the intended use of the system will be built to a specification that can have the additional use as a suppressor by closing or plugging the Threaded exhaust ports 6 closed, and maintain pressure.

If utilizing a suppressor, the gas exhaust port 6 size and the housing 9 wall thickness will be directly correlated with firearm caliber psi or hand loaded psi. Thus, will have to be made for the intended use of a suppressor and will correlate with chosen material to construct this device to contain pressure. These suppressor embodiments will be made by manufactures who have special permission to make suppressors. In other embodiments the system will utilize threaded gas ports 6 and fixed straight through gas ports 6 that do not have the option to be plugged or closed, this will allow the system to have the ability to tune the threaded gas ports 6, and the guarantee that the gas pressure will escape through the fixed gas ports 6, so that the intended use of embodied system will not include the option to be a suppressor, in which a suppressor traps all gas pressure and noise by function and the provided embodiment would always release gas. Any combination of these features stated or not stated will be claimed as part of this system for purpose of being a universal custom solution and potentially have the ability to be used and reconfigured for different firearms.

Figure 4:
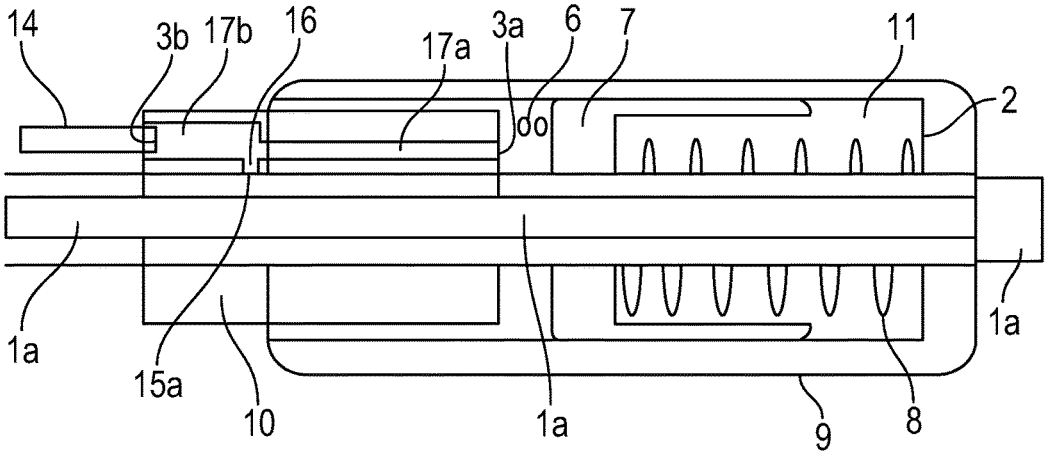
FIG. 4 is an internal view of the firearm accessory apparatus mounted onto an existing firearm barrel without the use of a barrel extension.
Figure 5:
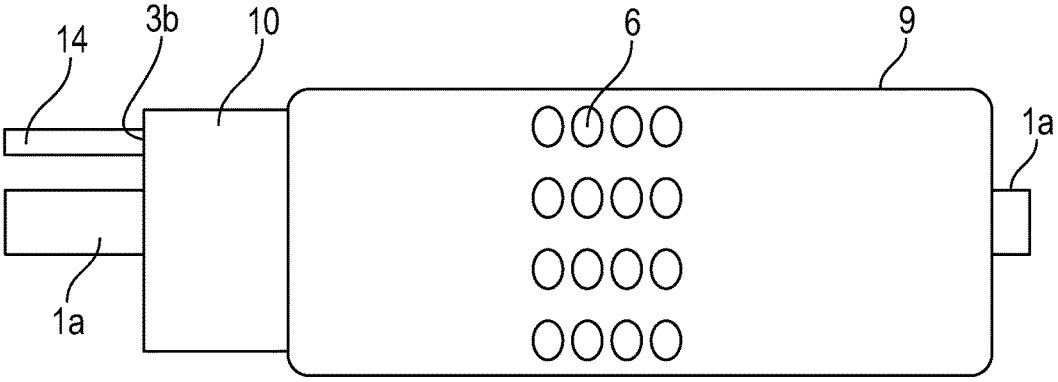
FIG. 5 is an external view of the firearm accessory apparatus mounted onto an existing firearm barrel without the use of a barrel extension.

Referring to an embodiment where the gas block 10 has no barrel extension (as shown in FIGS. 4 and 5). After the bullet 5 is fired and gases 4 enter the gas block 10, the bullet 5 will continue to travel through and out the barrel 1*a* or gas block 10 providing the back pressure behind the bullet 5 required to cycle both the firearm and the universal recoil system. The gas pressure 4 will flow into the firearms action and onto the face of the counter weight 7. The counter weight 7 feature can be made in any prismatic, or cylindrical shape or size so that it would have more or less mass and is used in combination with the spring feature 8 to provide a counter balance to kinetic energy and motion generated from the firearms recoil. This is to achieve an optimal spring to weight ratio for the purpose of the universal custom solution to counter acting the firearms recoil while still being able to have enough gas pressure 4 to cycle fire arm. Once gas pressure 4 pushes the weight 7 and spring 8 in opposite direction of actions movement then the weight 7 will expose exhaust ports 6 to redirect gas 4, the combination of the weight 7 at being moved to the opposite end of the firearm and redirected gas pressure in upward direction to will create an opposite "forward and down" movement for the firearm to counter an "up and back" movement associated from recoil and barrel rise when firing a firearm. The counter weight 7 can be a solid ring piece in any prismatic shape or size with an aperture through its longitudinal axis, to slide from one end of the barrel 1*a* to the other in a reciprocating movement, using the barrel 1*a* as a guide rod. The inner diameter of counter weight 7 can be slightly larger than barrel 1*a* to promote a smooth movement of weight 7 within the system. Or the weight 7 could utilize the shell housing 9 internal wall as point of contact for the movement within the systems interior volume with lubricant to assist in function.

The counter weight 7, can also feature grooves or pockets on either end or face of its longitudinal axis to enhance of the system, for example a circular groove can be cut onto face of the counter weight 7 to create a pocket between the gas block 10 and the forward gas ports 3*a* to increase the gas pressure volume within the system to so that more gas would be available within both the firearm and universal custom recoil system to ensure both operate synergistically as the fire arm completes its firing cycle and the universal custom recoil system counter balances the movement. If a pocket, groove or material is removed on the back end of counter weight 7 it would be to encase the spring or if an annular cutter is used on the rear end of counter weight then the counter weight could be seated inside of the spring enabling the weight to impact the end wall of the shell housing before the spring would be overly compressed past the spring specified maximum deflection distance. multiple variances of weights are included for this system for purpose of being a universal custom solution and potentially can be used and reconfigured for different firearms, and the ability to choose to either have the counter weight make contact with the end wall 2 or not can be determined by the spring specification of the spring chosen for the device. This design is made to counter multiple aspects of recoil and effectively aid in consecutive accurate follow up shots. Due to included but not limited to different types of firearm platforms, caliber psi, hand loaded ammunition psi, noise level, barrel rise or any other aspect of perceived recoil. This apparatus can be encompassed in multiple different embodiments using alternative variations in parts, shapes, and in multiple combinations but still surround the designs principle as a universal custom recoil solution system for desired effect on recoil.

FIG. 1 is a sectional view showing the internals of the firearm accessory apparatus comprising a gas block and barrel extension before a bullet reaches the gas block. In one embodiment of the invention, the bullet 5 is fired and is discharged through a firearm barrel 1*a*, and then makes it way through a barrel extension 1*b* until it exists the firearm. The barrel extension 1*b* having a gas block 10 mounted along it's outer perimeter along its rear region. The gas block 10 having at least one gas block receiver opening to accept gases escaping from the barrel extension 1*b* along the at least one barrel extension gas port 15*b*. Each gas block receiver opening 16 permitting the internal gasses to travel through it's internal by means of at least one forward pathways 17*a* or rearward pathways 17*b* (shown in FIG. 4). The forward pathways 17*a* leading to respective forward path ports 3*a* to allow the internal gasses to escape into the front of the gas block 10, but within the shell 9. The weight 7 is then pushed forward by force created by the release of gasses into the major interior volume 11, which in turn applies pressure to a spring 8 to be pushed forward towards the end of the firearm towards the end wall 2. The gas block receiver openings 16 coincide with the barrel extension gas ports 15*b* in terms of numerosity and specific location for which they are positioned.

FIG. 2 is a sectional view showing the internals of the firearm accessory apparatus comprising a gas block and barrel extension after a bullet reaches the gas block. In one embodiment of the invention, the bullet 5 is passing through the barrel extension 1*b* and as a result the gas block 10, more specifically, the gas block receiver opening 16 receive the gasses from within the barrel extension 1*b*, through the barrel extension gas ports 15*b*, and direct it towards the gas block forward gas ports 3*a* while traveling through the forward pathway 17*a*, or optionally to the rearward gas ports 3*b* (shown in FIG. 4), while traveling through the rearward pathway 17*b* (shown in FIG. 4). The forward gas ports 3*a* expel gasses 4 towards the front of the gas block 10 resulting in the weight 7 being pushed forward and the spring 8 being compressed during the operation of the firearm. However, when the spring 8 returns to it's expended shape it pushes the weight 7 back and allowing the gasses 4 to exit through the gas exhaust ports 6.

Figure 3:
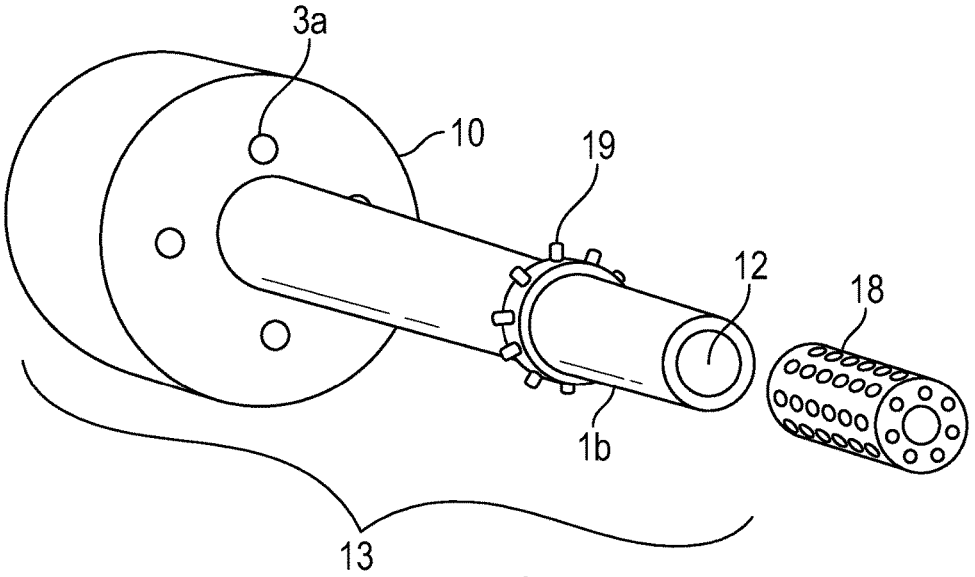
FIG. 3 is a frontal view of a base assembly, showing the gap block, gas ports, and barrel extension.

FIG. 3 is a frontal view of a base assembly, showing the gap block, gas ports, and barrel extension. In one embodiment of the invention, the base assembly 13 comprising a gas block 10 and a barrel extension 1*b*. The gas block 10 optionally having a plurality of forward gas ports 3*a*. The barrel extension may incorporate weight stopper 19 along the outer perimeter of its longitudinal axis. The barrel extension 1*b* may integrate a muzzle 18 along the barrel extension endpoint.

FIG. 4 is an internal view of the firearm accessory apparatus mounted onto an existing firearm barrel without the use of a barrel extension. In one embodiment of the invention, a firearm having an existing firearm barrel 1*a* with at least one barrel gas port 15*a* to allow gasses 4 to escape into a gas block receiver opening 16 and be directed to either a forward pathway 17*a* or rearward pathway 17*b* and existing out from the gas block 10 through the forward gas ports 3*a* or rearward gas ports 3*b*, respectively. The rearward gas port 3*b* leads gasses 4 to towards the gas tube 14 directly connected with the firearm. The weight 7 is pushed forward by the gasses 4 (shown in FIGS. 1 and 2) within the major interior volume 11, which in turn pushes the spring 8 into a compressed state as the weight 7 pushes forward towards the end wall 2. The barrel 1*a* and the weight 7 and spring 8 are encapsulated by a shell 9 having exhaust ports 6 to allow for gasses 4 within the major interior volume 11 to escape outward.

FIG. 5 is an external view of the firearm accessory apparatus mounted onto an existing firearm barrel without the use of a barrel extension. In one embodiment of the invention, an existing firearm barrel 1*a* having a gas block 10 mounted onto its outer perimeter, and having a shell partially encapsulate the gas block 10. The gas block having a rear gas port 3*b* leading to a gas tube 14. The shell 9 having a plurality of gas ports 6 along its exterior perimeter. The shell encapsulating the counter weight assembly (as shown in FIG. 4) such as the weight 7 and the spring 8.

A universal custom recoil system comprising: a provided barrel from either a firearm or be provided by the universal custom recoil solution its self; and a gas block with a forward and rearward end on its longitudinal axis that has an aperture from the front to rear, integrated gas ports and pathways to direct propellant into systems interior volume on to the front face of the counter weight, also providing a point of attachment for the shell housing to encase the device and to be mounted itself or secured to the provided barrel.

A prismatic shaped shell housing with a forward and rearward end, a longitudinal axis, gas exhaust ports, two connecting apertures on opposing front and rear ends, the front aperture larger than the rear; the larger front aperture is to be mounted or connected to the gas block of the system and the rear aperture to be tightly fitted around a provided barrel thus encapsulating the major interior volume and creating an end wall.

There will be two interior volumes within the shell housing that would be separated by the provided barrel that the system shell housing surrounds, one minor interior volume being within the barrel and the other outside of the barrel or barrel extension being the major interior volume.

The counter weight with a central aperture through its a longitudinal axis with a front and rear end, to be mounted on and reciprocate from front to back of the systems major interior volume around provided barrel as a guide rod in conjunction with a spring to function as a counter balance to the firearms kinetic energy by providing a moving mass, to counter the recoil from the firearms action movement; and a spring located between the counter weight and end wall within the major interior volume, that is coupled or set with the counter weight to absorb force generated within the apparatus and reset the counter weight to its original position after being compressed by gas pressure.

The barrel can be provided by a firearm and provide a gas port hole location for mounting or attaching a gas block to, or be provided by the universal custom recoil system itself when embodied with a gas block with a barrel extension.

The gas block would provide a barrel extension and additional gas port, the bas block base would attach to muzzle or end tip of barrel and provide a foundation for the reciprocating movement feature in the apparatus to operate on as a guide rod, and as an embodiment with a barrel extension can also provide an additional muzzle or muzzle threads to attach other or extra accessories to the firearm.

The a prismatic shell housing which can also be cylindrical in outside shape and provides a major interior volume and minor interior volume within barrel, and provide a cylindrical or prismatic Interior volume to encase the apparatus.

The prismatic shell housing which it features exhaust ports that are circular, threaded, slotted, straight or in any shape to release internal gas pressure, when counter weight reciprocating movement is allows for the gas pressure to be redirected to exhaust port.

The exhaust ports may be threaded can also be plugged, closed or blocked by an object with matching threads in order adjust the direction of the of gas pressure when released.

The exhaust ports may be plugged, closed or blocked to trap gas pressure and sound within the apparatus, would be an embodiment of the universal custom recoil solution that would also be featured as a silencer or suppressor.

A counter weight may be as a prismatic or cylindrical shape to fit within major interior volume and around provided barrel, to work in conjunction with the spring to operate as a counter balancing moving mass to the firearms action movement using the barrel as a guide rod to reciprocate in a longitudinal backward and forward movement.

A counter weight which has circular grooves, pockets, holes, or removed mass on either longitudinal front face, back end or radial sides of weight to create additional volume to fit more gas pressure or longer spring within the universal custom recoil solution interior major volume.

A firearm comprising a barrel having a muzzle or gas port, a universal custom recoil system will comprising: a provided barrel from either a firearm or be provided by the universal custom recoil solution its self; and a gas block with a forward and rearward end on its longitudinal axis that has an aperture from the front to rear, integrated gas ports and pathways to direct propellant into systems interior volume on to the front face of the counter weight, also providing a point of attachment for the shell housing to encase the device and to be mounted itself or secured to the provided barrel.

The prismatic shaped shell housing with a forward and rearward end, a longitudinal axis, gas exhaust ports, two connecting apertures on opposing front and rear ends, the front aperture larger than the rear, the larger front aperture is to be mounted or connected to the gas block of the system and the rear aperture to be tightly fitted around a provided barrel thus encapsulating the major interior volume and creating an end wall.

There will be two interior volumes within the shell housing that would be separated by the provided barrel that the system shell housing surrounds, one minor interior volume being within the barrel and the other outside of the barrel or barrel extension being the major interior volume; and a counter weight with a central aperture through its a longitudinal axis with a front and rear end, to be mounted on and reciprocate from front to back of the systems major interior volume around provided barrel as a guide rod in conjunction with a spring to function as a counter balance to the firearms kinetic energy by providing a moving mass, to counter the recoil from the firearms action movement; and a spring located between the counter weight and end wall within the major interior volume, that is coupled or set with the counter weight to absorb force generated within the apparatus and reset the counter weight to its original position after being compressed by gas pressure.

A firearm wherein a barrel can be provided by a firearm and provide a gas port hole location for mounting or attaching a gas block to, or be provided by the universal custom recoil system itself when embodied with a gas block with a barrel extension.

The gas block would provide a barrel extension and additional gas port, the gas block would attach to muzzle or end tip of barrel and provide a foundation for the reciprocating movement feature in the apparatus to operate on as a guide rod, and as an embodiment with a barrel extension can also provide an additional muzzle or muzzle threads to attach other or extra accessories to the firearm.

A prismatic shell housing may be cylindrical in outside shape and provides a major interior volume and minor interior volume within barrel, and provide a cylindrical or prismatic Interior volume to encase the apparatus.

A prismatic shell housing which features exhaust ports that are circular, threaded, slotted, straight or in any shape to release internal gas pressure, when counter weight reciprocating movement is allows for the gas pressure to be redirected to exhaust port.

The exhaust ports which can be threaded can also be plugged, closed or blocked by an object with matching threads in order adjust the direction of the of gas pressure when released.

The exhaust ports are all exhaust ports are plugged, closed or blocked to trap gas pressure and sound within the apparatus, would be an embodiment of the universal custom recoil solution that would also be featured as a silencer or suppressor.

A counter weight may be featured as a prismatic or cylindrical shape to fit within major interior volume and around provided barrel, to work in conjunction with the spring to operate as a counter balancing moving mass to the firearms action movement using the barrel as a guide rod to reciprocate in a longitudinal backward and forward movement.

A counter weight may be circular grooves, pockets, holes, or removed mass on either longitudinal front face, back end or radial sides of weight to create additional volume to fit more gas pressure or longer spring within the universal custom recoil solution interior major volume.

What is claimed is:

1. An apparatus, comprising:

a base assembly configured to be mounted to a firearm barrel;

the base assembly, comprising:

a gas block mounted along the outer perimeter of a barrel extension;

the barrel extension extending from a firearm barrel to a front of a firearm and having at least one barrel extension gas port that is aligned with the at least one gas block receiver opening to allow for a volume of gasses to escape from an interior volume of the barrel extension into the gas block;

the gas block having at least one forward gas port directed towards the front of the firearm; and the volume of gasses received by the at least one gas block receiver opening flow into at least one forward pathway at an acute angle within the gas block and exit from the at least one forward gas port;

a counter weight assembly slidably mounted to longitudinally reciprocate along an exterior of the barrel extension rearward to forward and forward to rearward during operation of the firearm, the counter weight assembly, comprising:

a weight configured to slide along an outer perimeter of the barrel extension in front of the gas block and behind a spring;

the spring extending towards the front of the firearm surrounding the barrel extension;

a shell covering the base assembly and counter weight assembly, the shell comprising:

a plurality of exhaust ports which are opened when the counter weight assembly is pushed forward during the operation of the firearm and closed when the counter weight assembly is pushed rearward at the conclusion of the operation of the firearm to allow the gasses originating from the at least one barrel extension gas port maintained within an interior volume of the shell to escape during the operation of the firearm.

2. The apparatus of claim 1, wherein the gas block further comprising at least one rear gas port directed towards the rear of the firearm, towards a firearm gas tube.

3. The apparatus of claim 1, wherein the base assembly, the counter weight assembly, and the shell are removable.

4. The apparatus of claim 1, wherein the barrel extension having a weight stopper to allow for the weight to be spaced apart from the gas ports, wherein the weight is maintained in position along the barrel extension with the weight stopper along the rear and the spring along the front.

5. The apparatus of claim 1, wherein the gas block has two, three, or four gas block receiver openings.

6. The apparatus of claim 1, wherein the barrel extension has at least two, three, or four barrel extension gas ports.

7. The apparatus of claim 1, wherein the gas block has two, three, or four forward gas ports directed towards the front of the firearm.

8. The apparatus of claim 1, wherein the exhaust ports are user configurable prior to operation of the firearm, allowing an external user to preconfigure which exhaust ports should be opened when the firearm is operation.

9. The apparatus of claim 1, wherein the gas block provides a point of attachment for the shell to encase the base assembly.

10. The apparatus of claim 1, wherein the barrel extension is configured to permit attachment of a muzzle along the barrel extension endpoint.

11. An apparatus, comprising:

a base assembly configured to be mounted to a firearm barrel;

the base assembly, comprising:

a gas block mounted along an outer perimeter of a barrel extension;

the barrel extension extending from a firearm barrel to a front of a firearm and having at least one barrel extension gas port that is aligned with at least one gas block receiver opening to allow for a volume of gasses to escape from an interior volume of the barrel extension into the gas block;

the gas block having at least one forward gas port directed towards the front of the firearm; and the volume of gasses received by the at least one gas block receiver opening flow into at least one forward pathway at a right angle within the gas block and exit from the at least one forward gas port;

a counter weight assembly slidably mounted to longitudinally reciprocate along an exterior of the barrel extension rearward to forward and forward to rearward during operation of the firearm, the counter weight assembly, comprising:

a weight configured to slide along an outer perimeter of the barrel extension in front of the gas block and behind a spring;

the spring extending towards the front of the firearm surrounding the barrel extension;

a shell covering the base assembly and counter weight assembly, the shell comprising:

a plurality of exhaust ports which are opened when the counter weight assembly is pushed forward during the operation of the firearm and closed when the counter weight assembly is pushed rearward at the conclusion of the operation of the firearm to allow the gasses originating from the at least one barrel extension gas port maintained within an interior volume of the shell to escape during the operation of the firearm.

12. The apparatus of claim 11, wherein the gas block apparatus further comprising at least one rear gas port directed towards the rear of the firearm, towards a firearm gas tube.

13. The apparatus of claim 11, wherein the gas block has two, three, or four gas block receiver openings.

14. The apparatus of claim 11, wherein the barrel extension has at least two, three, or four barrel extension gas ports.

15. The apparatus of claim 11, wherein the gas block has two, three, or four forward gas ports directed towards the front of the firearm.

16. The apparatus of claim 11, wherein the gas block provides a point of attachment for the shell to encase the base assembly.

17. The apparatus of claim 11, wherein the barrel extension is configured to permit attachment of firearm accessories along the barrel extension endpoint.

18. An apparatus, comprising:

a gas block mounted along an outer perimeter of an existing firearm barrel;

the gas block having at least one gas block receiver opening aligned directly with at least one barrel gas port;

the gas block having at least one forward gas port directed towards a front of the gas block; and the at least one gas block receiver opening receives a volume of gasses from the at least one barrel gas port through an at least one forward pathway within the gas block and enables the volume of gasses to exit from the at least one forward gas port towards the front of the gas block;

a counter weight assembly slidably mounted to longitudinally reciprocate along the existing firearm barrel rearward to forward and forward to rearward during operation of a firearm, the counter weight assembly, comprising:

a weight a configured in front of the gas block and behind a spring, the spring extending towards the front of the firearm surrounding the existing firearm barrel;

a shell covering the gas block and counter weight assembly, the shell comprising:

a plurality of exhaust ports which are opened when the counter weight assembly is pushed forward during the operation of the firearm and closed when the counter weight assembly is pushed rearward at the conclusion of the operation of the firearm to allow the volume of gasses originating from the at least one barrel gas port maintained within an interior volume of the shell to escape during the operation of the firearm.

19. The apparatus of claim 18, wherein the gas block further comprising at least one rear gas port directing the volume of gasses from the interior volume of the existing firearm barrel towards the a firearm gas tube.

20. The apparatus of claim 18, wherein the base assembly, the counter weight assembly, and the shell are removeable.

* * * * *